US010504502B2

(12) United States Patent
Hamano et al.

(10) Patent No.: US 10,504,502 B2
(45) Date of Patent: Dec. 10, 2019

(54) SOUND CONTROL DEVICE, SOUND CONTROL METHOD, AND SOUND CONTROL PROGRAM

(71) Applicant: YAMAHA CORPORATION, Hamamatsu-shi (JP)

(72) Inventors: Keizo Hamano, Fujieda (JP); Yoshitomo Ota, Hamamatsu (JP); Kazuki Kashiwase, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 139 days.

(21) Appl. No.: 15/709,974

(22) Filed: Sep. 20, 2017

(65) Prior Publication Data

US 2018/0018957 A1 Jan. 18, 2018

Related U.S. Application Data

(63) Continuation of application No. PCT/JP2016/058494, filed on Mar. 17, 2016.

(30) Foreign Application Priority Data

Mar. 25, 2015 (JP) ..... 2015-063266

(51) Int. Cl.
*G10L 13/06* (2013.01)
*G10L 13/04* (2013.01)
(Continued)

(52) U.S. Cl.
CPC ..... *G10L 13/06* (2013.01); *G10L 13/027* (2013.01); *G10L 13/04* (2013.01); *G10L 13/043* (2013.01);
(Continued)

(58) Field of Classification Search
CPC ..... G10L 13/00; G10L 13/02; G10L 13/04; G10L 13/043; G10L 13/047; G10L 13/06; G10L 13/08; G10L 2013/105
See application file for complete search history.

(56) References Cited

U.S. PATENT DOCUMENTS 3,892,919 A * 7/1975 Ichikawa ..... G10L 13/07 704/267
4,278,838 A * 7/1981 Antonov ..... G10L 13/00 704/260
(Continued)

FOREIGN PATENT DOCUMENTS

JP 51100713 A 9/1976
JP 09062297 A 3/1997
(Continued)

OTHER PUBLICATIONS

International Search Report issued in Intl. Appln. No. PCT/JP2016/058494 dated May 31, 2016. English translation provided.
(Continued)

*Primary Examiner* — Eric Yen
(74) *Attorney, Agent, or Firm* — Rossi, Kimms & McDowell LLP

(57) ABSTRACT

A sound control device includes: a detection unit that detects a first operation on an operator and a second operation on the operator, the second operation being performed after the first operation; and a control unit that causes output of a second sound to be started, in response to the second operation being detected. The control unit causes output of a first sound to be started before causing the output of the second sound to be started, in response to the first operation being detected.

21 Claims, 8 Drawing Sheets

(51) Int. Cl.
*G10L 13/047* (2013.01)
*G10L 13/027* (2013.01)
*G10L 13/08* (2013.01)
*G10L 13/10* (2013.01)

(52) U.S. Cl.
CPC ..... *G10L 13/047* (2013.01); *G10L 13/08* (2013.01); *G10L 2013/105* (2013.01)

(56) References Cited

U.S. PATENT DOCUMENTS 4,862,504 A * 8/1989 Nomura ..... G10L 13/08 704/260
5,703,311 A * 12/1997 Ohta ..... G10H 7/10 704/209
5,864,812 A * 1/1999 Kamai ..... G10L 13/02 704/268
6,173,263 B1 * 1/2001 Conkie ..... G10L 13/07 704/260
6,366,883 B1 * 4/2002 Campbell ..... G10L 13/07 704/258
6,477,495 B1 * 11/2002 Nukaga ..... G10L 13/10 704/260
6,961,704 B1 * 11/2005 Phillips ..... G10L 13/10 704/267
2003/0009344 A1 * 1/2003 Kayama ..... G10L 13/02 704/500
2009/0306987 A1 * 12/2009 Nakano ..... G10H 1/366 704/260
2014/0000443 A1 1/2014 Iwase et al.
2014/0136207 A1 5/2014 Kayama et al.

FOREIGN PATENT DOCUMENTS

JP 10319993 A 12/1998
JP 2002202788 A 7/2002
JP 2014010175 A 1/2014
JP 2014098801 A 5/2014

OTHER PUBLICATIONS

Written Opinion issued in Intl. Appln. No. PCT/JP2016/058494 dated May 31, 2016.
International Preliminary Report on Patentability issued in Intl. Appln. No. PCT/JP2016/058494 dated Jan. 17, 2017. English translation provided.

* cited by examiner

FIG. 3A
30
| c1 | c2 | c3 | c41 | c42 |
|---|---|---|---|---|
| ha | ru | yo | ko | i |
31
| CONSONANT SOUND TYPE | CONSONANT SOUND GENERATION TIMING |
|---|---|
| s、h、sh | IMMEDIATE |
| m、n | 0.01 SEC DELAY |
| b、d、g、r | 0.02 SEC DELAY |
| : | : |
| NONE | NOT SOUNDED |
FIG. 3B
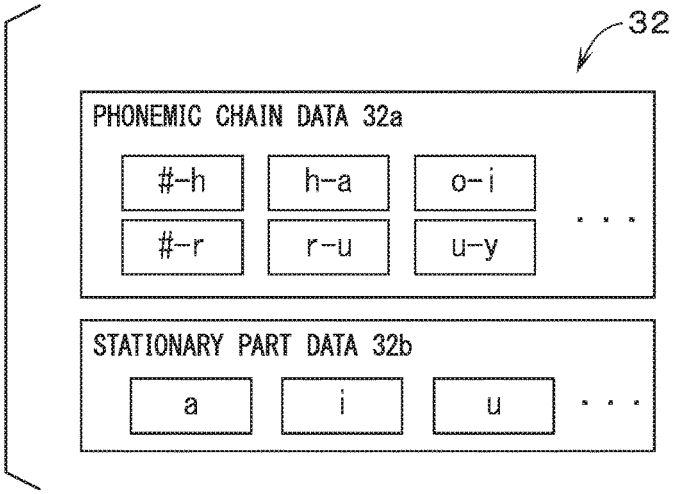
FIG. 3C
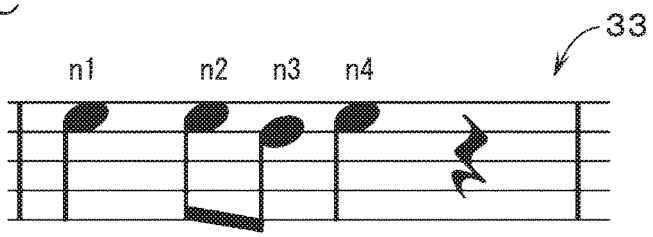

SOUND CONTROL DEVICE, SOUND CONTROL METHOD, AND SOUND CONTROL PROGRAM

CROSS-REFERENCE TO RELATED APPLICATIONS

The present application is a continuation application of International Application No. PCT/JP2016/058494, filed Mar. 17, 2016, which claims priority to Japanese Patent Application No. 2015-063266, filed Mar. 25, 2015. The contents of these applications are incorporated herein by reference.

BACKGROUND OF THE INVENTION

Field of the Invention

The present invention relates to a sound control device, a sound control method, and a sound control program capable of outputting a sound without a noticeable delay when performing in real-time.

Description of Related Art

Conventionally, a singing sound synthesizing apparatus described in Japanese Unexamined Patent Application, First Publication No. 2002-202788 that performs singing sound synthesis on the basis of performance data input in real-time is known. Phoneme information, time information, and singing duration information earlier than a singing start time represented by the time information are input to this singing sound synthesizing apparatus. Further, the singing sound synthesizing apparatus generates a phoneme transition time duration based on the phoneme information, and determines a singing start time and a continuous singing time of first and second phonemes on the basis of the phoneme transition time duration, the time information, and the singing duration information. As a result, for the first and second phonemes, it is possible to determine desired singing start times before and after the singing start time represented by the time information, and to determine continuous singing times different from the singing duration represented by the singing duration information. Therefore, it is possible to generate a natural singing sound as first and second singing sounds. For example, if a time earlier than the singing start time represented by the time information is determined as the singing start time of the first phoneme, it is possible to perform singing sound synthesis that approximates human singing by making initiation of a consonant sound sufficiently earlier than initiation of a vowel sound.

In a singing sound synthesizing apparatus according to the related art, by inputting performance data before an actual singing start time T1 at which actual singing is performed, sound generation of a consonant sound is started before the time T1, and sound generation of a vowel sound is started at the time T1. Consequently, after input of performance data of a real-time performance, sound generation is not performed until the time T1. As a result, there is a problem in that a delay occurs in sound generation of a singing sound after performing in real-time, resulting in poor playability.

SUMMARY OF THE INVENTION

An example of an object of the present invention is to provide a sound control device, a sound control method, and a sound control program capable of outputting sound without a noticeable delay when performing in real-time.

A sound control device according to an aspect of the present invention includes: a detection unit that detects a first operation on an operator and a second operation on the operator, the second operation being performed after the first operation; and a control unit that causes output of a second sound to be started, in response to the second operation being detected. The control unit causes output of a first sound to be started before causing the output of the second sound to be started, in response to the first operation being detected.

A sound control method according to an aspect of the present invention includes: detecting a first operation on an operator and a second operation on the operator, the second operation being performed after the first operation; causing output of a second sound to be started, in response to the second operation being detected; and causing output of a first sound to be started before causing the output of the second sound to be started, in response to the first operation being detected.

A sound control program according to an aspect of the present invention causes a computer to execute: detecting a first operation on an operator and a second operation on the operator, the second operation being performed after the first operation; causing output of a second sound to be started, in response to the second operation being detected; and causing output of a first sound to be started before causing the output of the second sound to be started, in response to the first operation being detected.

In a singing sound generating apparatus according to an embodiment of the present invention, sound generation of a singing sound is started by starting sound generation of a consonant sound of the singing sound in response to detection of a stage prior to a stage of instructing a start of sound generation, and starting sound generation of a vowel sound of the singing sound when the start of sound generation is instructed. Therefore, it is possible to generate a natural singing sound without a noticeable delay when performing in real-time.

BRIEF DESCRIPTION OF THE DRAWINGS

FIG. 3A is a diagram for explaining syllable information acquisition processing to be processed by the singing sound generating apparatus according to the embodiment of the present invention.

FIG. 3B is a diagram for explaining speech element data selection processing to be processed by the singing sound generating apparatus according to the embodiment of the present invention.

FIG. 3C is a diagram for explaining sound generation instruction acceptance processing to be processed by the singing sound generating apparatus according to the embodiment of the present invention.

EMBODIMENTS FOR CARRYING OUT THE INVENTION

Figure 1:
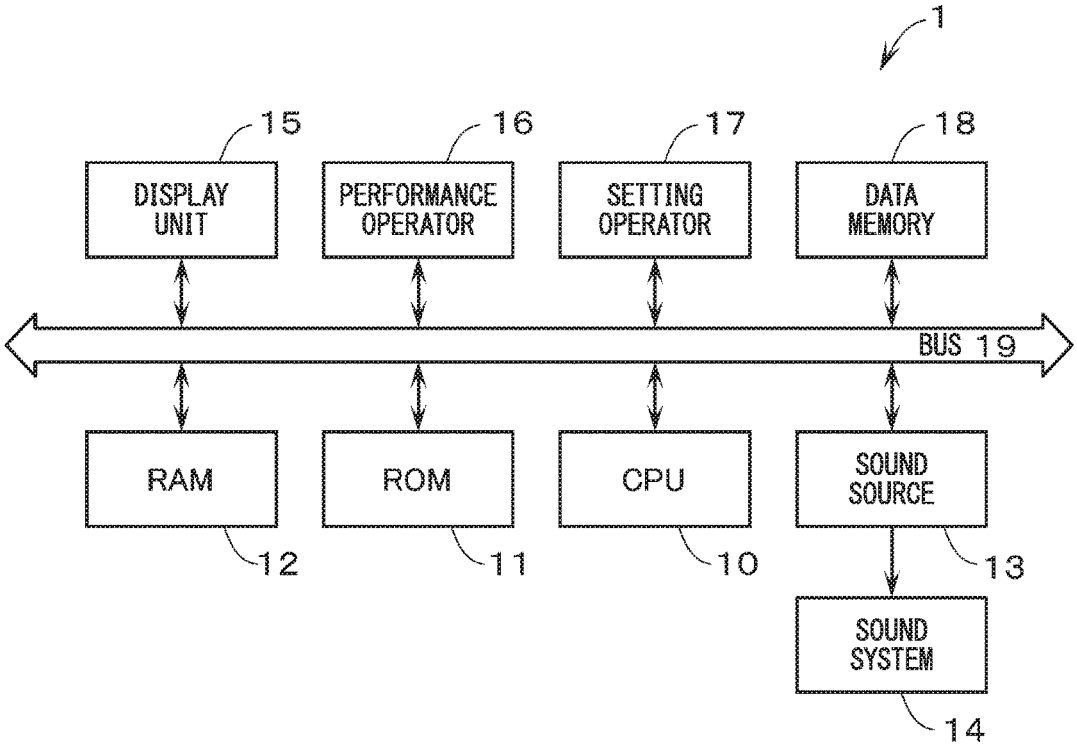
FIG. 1 is a functional block diagram showing a hardware configuration of a singing sound generating apparatus according to an embodiment of the present invention.

FIG. 1 is a functional block diagram showing a hardware configuration of a singing sound generating apparatus according to an embodiment of the present invention.

A singing sound generating apparatus 1 according to the embodiment of the present invention shown in FIG. 1 includes a CPU (Central Processing Unit) 10, a ROM (Read Only Memory) 11, a RAM (Random Access Memory) 12, sound source 13, a sound system 14, a display unit (display) 15, a performance operator 16, a setting operator 17, a data memory 18, and a bus 19.

A sound control device may correspond to the singing sound generating apparatus 1. A detection unit, a control unit, an operator, and a storage unit of this sound control device, may each correspond to at least one of these configurations of the singing sound generating apparatus 1. For example, the detection unit may correspond to at least one of the CPU 10 and the performance operator 16. The control unit may correspond to at least one of the CPU 10, the sound source 13, and the sound system 14. The storage unit may correspond to the data memory 18.

The CPU 10 is a central processing unit that controls the whole singing sound generating apparatus 1 according to the embodiment of the present invention. The ROM 11 is a nonvolatile memory in which a control program and various data are stored. The RAM 12 is a volatile memory used for a work area of the CPU 10 and the various buffers. The data memory 18 stores a syllable information table including text data of lyrics, and a phoneme database storing speech element data of a singing sound, and the like. The display unit 15 is a display unit including a liquid crystal display or the like on which the operating state and various setting screens and messages to the user are displayed. The performance operator 16 is an operator for a performance, such as a keyboard, and includes a plurality of sensors that detect operation of the operator in a plurality of stages. The performance operator 16 generates performance information such as key-on and key-off, pitch, and velocity based on the on/off of the plurality of sensors. This performance information may be performance information of a MIDI (musical instrument digital interface) message. The setting operator 17 is various setting operation elements such as operation knobs and operation buttons for setting the singing sound generating apparatus 1.

The sound source 13 has a plurality of sound generation channels. Under the control of the CPU 10, one sound generation channel is allocated to the sound source 13 according to the real-time performance of a user using the performance operator 16. The sound source 13 reads out the speech element data corresponding to the performance from the data memory 18, in the allocated sound generation channel, and generates singing sound data. The sound system 14 converts the singing sound data generated by the sound source 13 into an analog signal by a digital/analog converter, amplifies the singing sound that is made into an analog signal, and outputs it to a speaker or the like. Further, the bus 19 is a bus for transferring data between each unit of the singing sound generating apparatus 1.

Figure 2A:
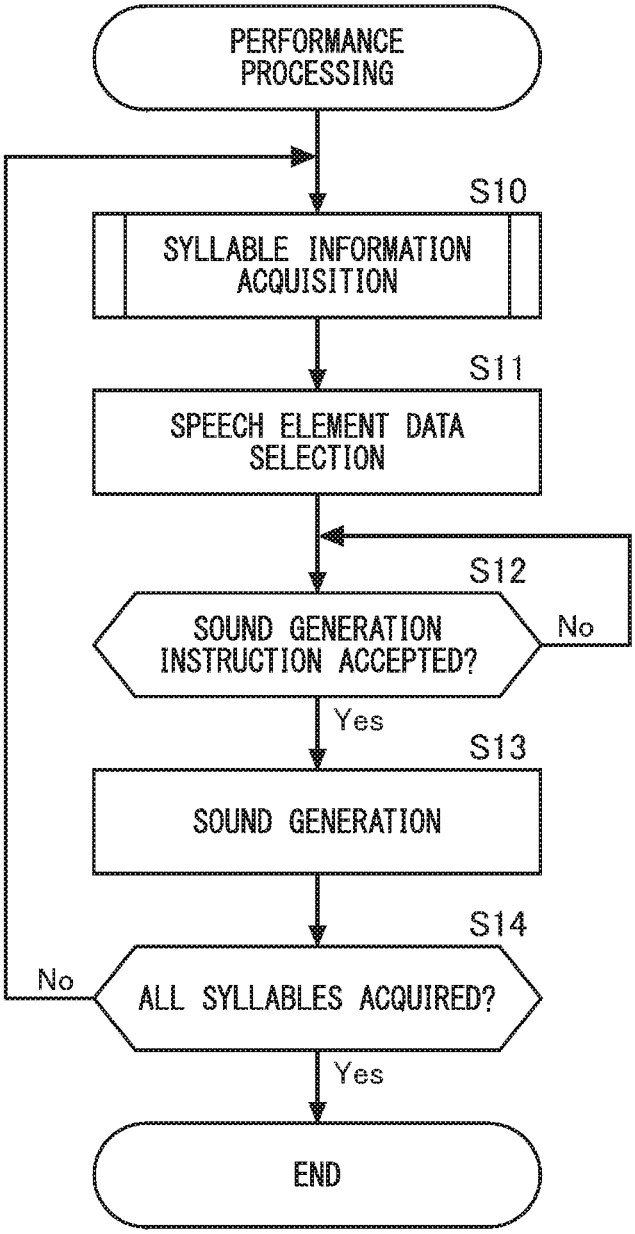
FIG. 2A is a flowchart of performance processing executed by the singing sound generating apparatus according to the embodiment of the present invention.
Figure 2B:
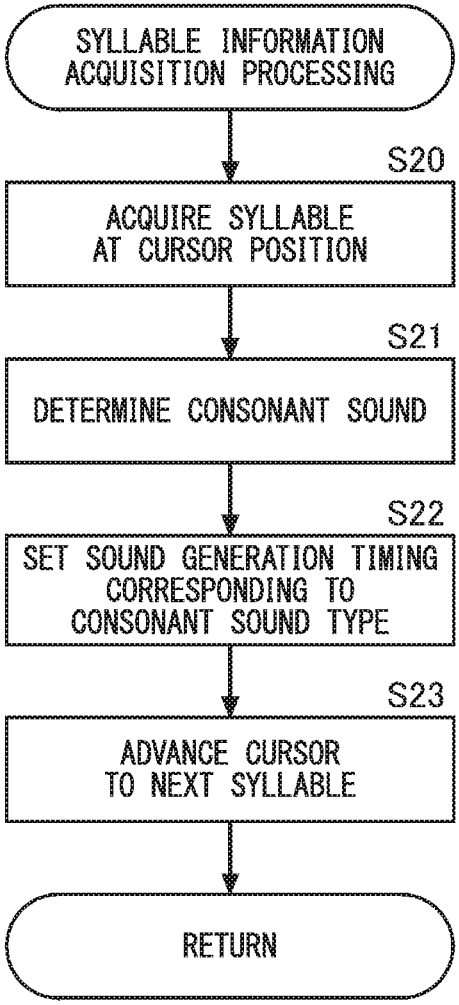
FIG. 2B is a flowchart of syllable information acquisition processing executed by the singing sound generating apparatus according to the embodiment of the present invention.
Figure 4:
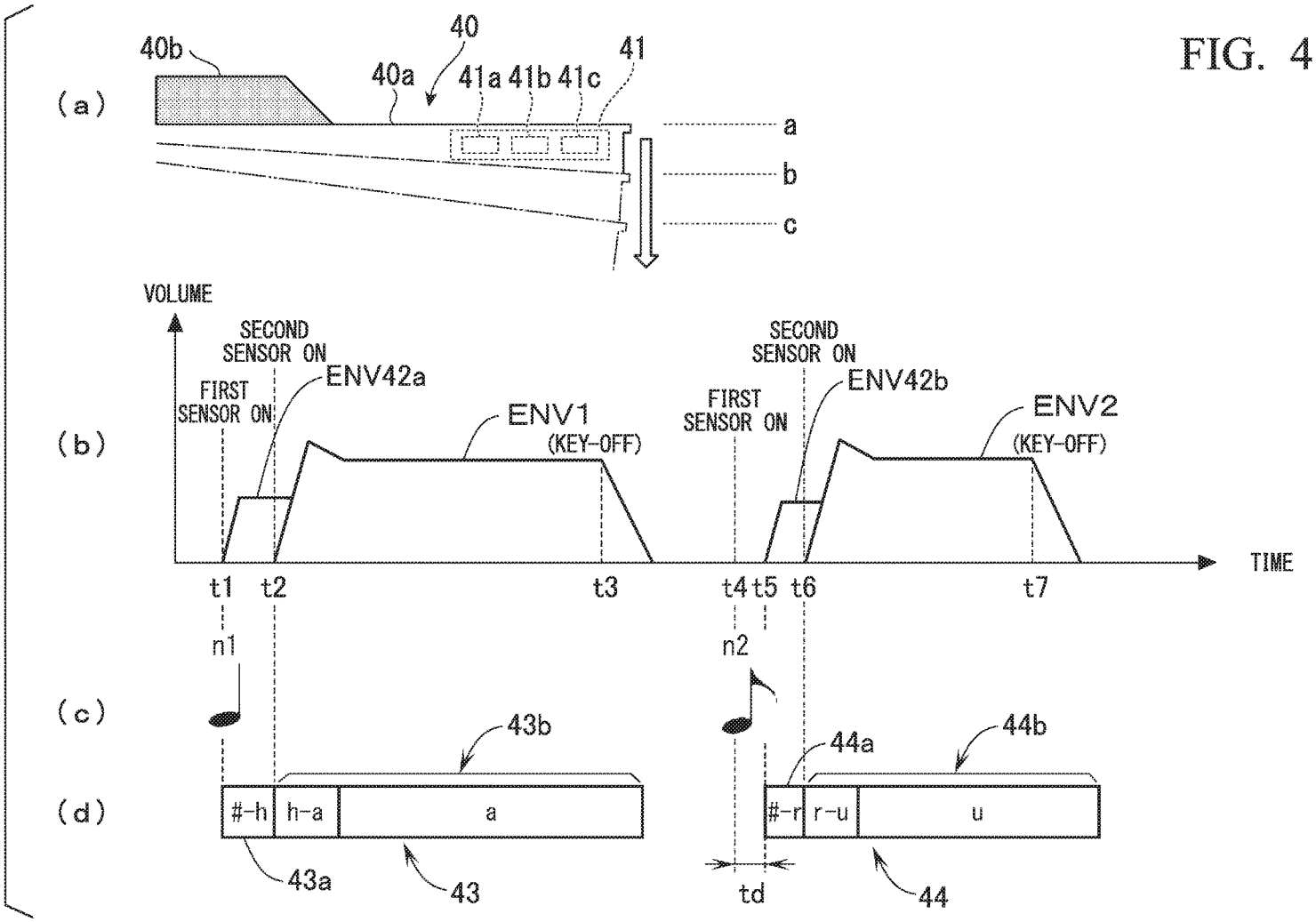
FIG. 4 is a diagram showing the operation of the singing sound generating apparatus according to the embodiment of the present invention.
Figure 5:
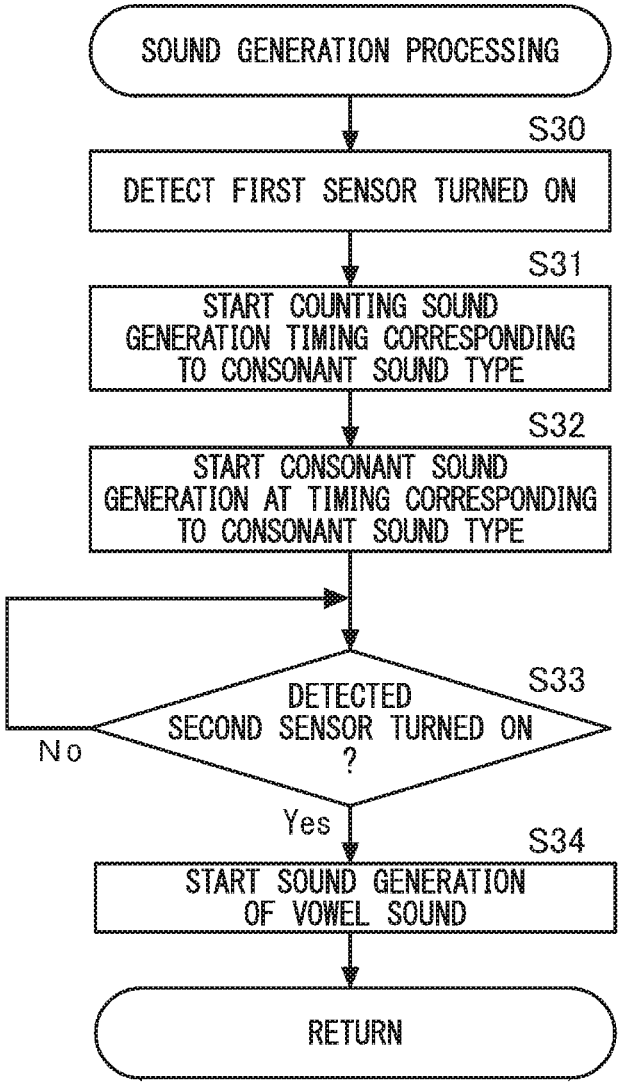
FIG. 5 is a flowchart of sound generation processing executed by the singing sound generating apparatus according to the embodiment of the present invention.

The singing sound generating apparatus 1 according to the embodiment of the present invention will be described below. Here, the singing sound generating apparatus 1 will be described by taking as an example a case where a keyboard 40 is provided as the performance operator 16. In the keyboard 40 which is the performance operator 16, there is provided an operation detection unit 41 including a first sensor 41*a*, a second sensor 41*b*, and a third sensor 41*c*, which detects a push-in operation of the keyboard in multiple stages (refer to part (a) of FIG. 4). When the operation detection unit 41 detects operation of the keyboard 40, the performance processing of the flowchart shown in FIG. 2A is executed. FIG. 2B shows a flowchart of syllable information acquisition processing in this performance processing. FIG. 3A is an explanatory diagram of the syllable information acquisition processing in the performance processing. FIG. 3B is an explanatory diagram of speech element data selection processing. FIG. 3C is an explanatory diagram of sound generation acceptance processing. FIG. 4 shows the operation of the singing sound generating apparatus 1. FIG. 5 shows a flowchart of sound generation processing executed in the singing sound generating apparatus 1.

In the singing sound generating apparatus 1 shown in these figures, when the user performs in real-time, the performance is performed by a push-in operation of the keyboard which is the performance operator 16. As shown in part (a) of FIG. 4, the keyboard 40 includes a plurality of white keys 40*a* and black keys 40*b*. The plurality of white keys 40*a* and black keys 40*b* are each associated with different pitches. The interior of each of the white keys 40*a* and black keys 40*b* is provided with a first sensor 41*a*, a second sensor 41*b*, and a third sensor 41*c*. To describe by taking the white key 40*a* as an example, when the white key 40*a* starts to be pressed from a reference position and the white key 40*a* is slightly pushed in to an upper position a, the first sensor 41*a* is turned on and it is detected by the first sensor 41*a* that the white key 40*a* has been pressed (an example of the first operation). In this case, the reference position is a position in a state where the white key 40*a* is not pressed. When the finger is moved away from the white key 40*a* and the first sensor 41*a* is turned from on to off, it is detected that the finger has moved away from the white key 40*a* (push-in of the white key 40*a* has been released). When the white key 40*a* is pushed in to a lower position c, the third sensor 41*c* is turned on, and it is detected by the third sensor 41*c* that it has been pushed in to the bottom. When the white key 40*a* is pushed in to an intermediate position b which is an intermediate between the upper position a and the lower position c, the second sensor 41*b* is turned on. The depressed state of the white key 40*a* is detected by the first sensor 41*a* and the second sensor 41*b*. It is possible to control a start of sound generation and a stop of sound generation according to the depressed state. Furthermore, it is possible to control the velocity according to a time difference between the detection times by the two sensors 41*a* and 41*b*. That is to say, in response to the second sensor 41*b* becoming turned on (an example of detection of the second operation), sound generation is started at a volume corresponding to the velocity calculated from the detection times of the first sensor 41*a* and the second sensor 41*b*. The third sensor 41*c* is a sensor that detects that the white key 40*a* is pushed in to a deep position, and is able to control the volume and sound quality during sound generation.

The performance processing shown in FIG. 2A starts when specific lyrics corresponding to a musical score 33 to be played shown in FIG. 3C are designated prior to the performance. The syllable information acquisition processing of step S10 and the sound generation instruction acceptance processing of step S12, in the performance processing are executed by the CPU 10. The sound source 13 executes the speech element data selection processing of step S11 and the sound generation processing of step S13, under the control of the CPU 10.

The designated lyrics are delimited for each syllable. In step S10 of the performance processing, syllable information acquisition processing that acquires syllable information representing the first syllable of the lyrics is performed. The syllable information acquisition processing is executed by the CPU 10, and a flowchart showing the details thereof is shown in FIG. 2B. In step S20 of the syllable information acquisition processing, the CPU 10 acquires the syllable at the cursor position. In this case, text data 30 corresponding to the designated lyrics is stored in the data memory 18. The text data 30 includes text data in which the designated lyrics are delimited for each syllable. A cursor is placed at the first syllable of the text data 30. As a specific example, a case where the text data 30 is text data corresponding to the lyrics specified corresponding to the musical score 33 shown in FIG. 3C will be described. In this case, the text data 30 is syllables c1 to c42 shown in FIG. 3A, that is, text data including five syllables of "ha", "ru", "yo", "ko", and "i". In the following, "ha", "ru", "yo", "ko", and "i" each indicate one letter of Japanese hiragana, being an example of syllables. For example, the syllable c1 is composed of a consonant "h" and a vowel "a", and is a syllable starting with the consonant "h" and continuing with the vowel "a" after the consonant "h". As shown in FIG. 3A, the CPU 10 reads out "ha" which is the first syllable c1 of the designated lyrics, from the data memory 18. The CPU 10 determines in step S21 whether the acquired syllable starts with a consonant sound or a vowel sound. "ha" starts with the consonant "h". Therefore, the CPU 10 determines that the acquired syllable starts with a consonant sound, and determines that the consonant "h" is to be output. Next, the CPU 10 determines the consonant sound type of the syllable acquired in step S21. Further, in step S22, the CPU 10 refers to the syllable information table 31 shown in FIG. 3A, and sets a consonant sound generation timing corresponding to the determined consonant sound type. The "consonant sound generation timing" is the time from when the first sensor 41*a* detects an operation until sound generation of the consonant sound is started. The syllable information table 31 defines a timing for each type of consonant sound. Specifically, for syllables such as the "sa" line in the Japanese syllabary diagram (consonant "s"), where sound generation of the consonant sound is prolonged, the syllable information table 31 defines that sound generation of the consonant sound is started immediately (for example, 0 sec later) in response to detection by the first sensor 41*a*. Since the consonant sound generation time is short for plosives (such as the "ba" line and the "pa" line in the Japanese syllabary diagram), the syllable information table 31 defines that sound generation of the consonant sound is started after a predetermined time elapses from detection by the first sensor 41*a*. That is, for example, the consonant sounds "s", "h", and "sh" are immediately generated. The consonant sounds "m" and "n" are generated with a delay of approximately 0.01 sec. The consonant sounds "b", "d", "g", and "r" are generated with a delay of approximately 0.02 sec. The syllable information table 31 is stored in the data memory 18. For example, since the consonant sound of "ha" is "h", "immediate" is set as the consonant sound generation timing. Then, proceeding to step S23, the CPU 10 advances the cursor to the next syllable of the text data 30, and the cursor is placed at "ru" of the second syllable c2. Upon completion of the process of step S23, syllable information acquisition processing is completed, and the process returns to step S11 of the performance processing.

The speech element data selection processing of step S11 is processing performed by the sound source 13 under the control of the CPU 10. The sound source 13 selects, from a phoneme database 32 shown in FIG. 3B, speech element data that causes the obtained syllable to be generated. In the phoneme database 32, "phonemic chain data 32*a*" and "stationary part data 32*b*" are stored. The phonemic chain data 32*a* is data of a phoneme piece when sound generation changes, corresponding to "consonants from silence (#)", "vowels from consonants", "consonants or vowels (of the next syllable) from vowels", and the like. The stationary part data 32*b* is the data of the phoneme piece when sound generation of the vowel sound continues. In the case where the syllable acquired in response to detecting the first key-on is "ha" of c1, the sound source 13 selects from the from the phonemic chain data 32*a*, a speech element data "#-h" corresponding to "silence→consonant h", and a speech element data "h-a" corresponding to "consonant h→vowel a", and selects from the stationary part data 32*b*, the speech element data "a" corresponding to "vowel a". In the following step S12, the CPU 10 determines whether or not a sound generation instruction has been accepted, and waits until a sound generation instruction is accepted. Next, the CPU detects that the performance has started and one of the keys of the keyboard has started to be pressed, and that the first sensor 41*a* of the key thereof is turned on. Upon detecting that the first sensor 41*a* is turned on, the CPU 10 determines in step S12 that a sound generation instruction based on a first key-on n1 has been accepted, and proceeds to step S13. In this case, the CPU 10 receives performance information, such as the timing of the key-on n1 and pitch information indicating the pitch of the key whose first sensor 41*a* is turned on, in the sound instruction acceptance process of step S12. For example, in the case where a user performs in real-time according to the musical score shown in FIG. 3C, the CPU 10 receives pitch information indicating a pitch of E5 when it accepts the sound generation instruction of the first key-on n1.

In step S13, the sound source 13 performs sound generation processing based on the speech element data selected in step S11 under the control of the CPU 10. A flowchart showing the details of sound generation processing is shown in FIG. 5. As shown in FIG. 5, when sound generation processing is started, the CPU 10 detects the first key-on n1 based on the first sensor 41 being turned on in step S30, and sets the sound source 13 with pitch information of the key whose first sensor 41*a* is turned on, and a predetermined volume. Next, the sound source 13 starts counting a sound generation timing corresponding to the consonant sound type set in step S22 of the syllable information acquisition processing. In this case, since "immediate" is set, the sound source 13 counts up immediately, and in step S32 starts sound generation of the consonant component of "#-h" at a sound generation timing corresponding to the consonant sound type. At the time of this sound generation, sound generation is performed at the set pitch of E5 and the predetermined volume. When sound generation of the consonant sound is started, the process proceeds to step S33. Next, the CPU 10 determines whether or not it has been detected that the second sensor 41*b* is turned on in the key in which it was detected that the first sensor 41*a* was turned on, and waits until the second sensor 41*b* is turned on. When the CPU 10 detects that the second sensor 41*b* is turned on, the process proceeds to step S34. Next, sound generation of the speech element data of the vowel component of '"h-a"→"a"' is started in the sound source 13, and "ha" of the syllable c1 is generated. The CPU 10 calculates the velocity corresponding to the time difference from the first sensor 41*a* being turned on to the second sensor 41*b* being turned on. At the time of sound generation, the vowel component of '"h-a"→"a"' is generated at the pitch of E5 received at the time of acceptance of the sound generation instruction of the key-on n1, and at a volume corresponding to the velocity. As a result, sound generation of a singing sound of "ha" of the acquired syllable c1 is started. Upon completion of the process of step S34, the sound generation processing is completed and the process returns to step S14. In step S14, the CPU 10 determines whether or not all the syllables have been acquired. Here, since there is a next syllable at the position of the cursor, the CPU 10 determines that not all the syllables have been acquired, and the process returns to step S10.

The operation of this performance processing is shown in FIG. 4. For example, when one of the keys on the keyboard 40 has started to be pressed and reaches the upper position a at time t1, the first sensor 41*a* is turned on, and a sound generation instruction of the first key-on n1 is accepted at time t1 (step S12). Before time t1, the first syllable c1 is acquired and the sound generation timing corresponding to the consonant sound type is set (step S20 to step S22). The sound generation of the consonant sound of the acquired syllable is started in the sound source 13 at the set sound generation timing from the time t1. In this case, since the set sound generation timing is "immediate", then as shown in part (b) of FIG. 4, at time t1, the consonant component 43*a* of "#-h" in the speech element data 43 shown in part (d) of FIG. 4 is generated at the pitch of E5 and the volume of the envelope indicated by a predetermined consonant envelope ENV42*a*. As a result, consonant component 43*a* of "#-h" is generated at the pitch of E5 and the predetermined volume indicated by the consonant envelope ENV42*a*. Next, when the key corresponding to the key-on n1 is pressed down to the intermediate position b and the second sensor 41*b* is turned on at time t2, sound generation of the vowel sound of the acquired syllable is started in the sound source 13 (step S30 to step S34). At the time of sound generation of this vowel sound, an envelope ENV1 having a volume of the velocity corresponding to the time difference between time t1 and time t2 is started, and the vowel component 43*b* of '"h-a"→"a"' in the speech element data 43 shown in part (d) of FIG. 4 is generated at the pitch of E5 and the volume of the envelope ENV1. As a result, sound generation of a singing sound of "ha" is generated. The envelope ENV1 is an envelope of a sustain sound in which the sustain persists until key-off of the key-on n1. The stationary part data of "a" in the vowel component 43*b* shown in part (d) of FIG. 4 is repeatedly reproduced until time t3 (key-off) at which the finger moves away from the key corresponding to the key-on n1 and the first sensor 41*a* turns from on to off. The CPU 10 detects that the key corresponding to the key-on n1 is turned off at time t3, and a key-off process is performed to mute the sound. Consequently, the singing sound of "ha" is muted in the release curve of the envelope ENV1, and as a result, sound generation is stopped.

By returning to step S10 in the performance processing, the CPU 10 reads "ru" which is the second syllable c2 on which the cursor of the designated lyrics is placed, from the data memory 18 in the syllable information acquisition processing of step S10. The CPU 10 determines that the syllable "ru" starts with the consonant "r" and determines that the consonant "r" is to be output. Also, the CPU 10 refers to the syllable information table 31 shown in FIG. 3A and sets a consonant sound generation timing according to the determined consonant sound type. In this case, since the consonant sound type is "r", the CPU 10 sets a consonant sound generation timing of approximately 0.02 sec. Further, the CPU 10 advances the cursor to the next syllable of the text data 30. As a result, the cursor is placed on "yo" of the third syllable c3. Next, in the speech element data selection processing of step S11, the sound source 13 selects from the phonemic chain data 32*a*, the speech element data "#-r" corresponding to "silence→consonant r" and the speech element data "r-u" corresponding to "consonant r→vowel u", and also selects from the stationary part data 32*b*, the speech element data "u" corresponding to "vowel u".

When the keyboard 40 is operated as the real-time performance progresses, and as the second depression it is detected that the first sensor 41*a* of the key is turned on, a sound generation instruction of a second key-on n2 based on the key whose first sensor 41*a* is turned on is accepted in step S12. This sound generation instruction acceptance processing of step S12 accepts a sound generation instruction based on the key-on n2 of the operated performance operator 16, and the CPU 10 sets the sound source 13 with the timing of the key-on n2, and pitch information indicating the pitch of E5. In the sound generation processing of step S13, the sound source 13 starts counting a sound generation timing corresponding to the set consonant sound type. In this case, since "approximately 0.02 sec" is set, the sound source 13 counts up after approximately 0.02 sec has elapsed, and starts sound generation of the consonant component of "#-r" at a sound generation timing corresponding to the consonant sound type. At the time of this sound generation, sound generation is performed at the set pitch of E5 and the predetermined volume. When it is detected that the second sensor 41*b* is turned on in the key corresponding to the key-on n2, sound generation of the speech element data of the vowel component of '"r-u"→"u"' is started in the sound source 13, and "ru" of the syllable c2 is generated. At the time of sound generation, the vowel component of '"r-u"→"u"' is generated at the pitch of E5 received at the time of acceptance of the sound generation instruction of the key-on n2, and at a volume according to the velocity corresponding to the time difference from the first sensor 41*a* being turned on to the second sensor 41*b* being turned on. As a result, sound generation of a singing sound of "ru" of the acquired syllable c2 is started. Further, in step S14, the CPU 10 determines whether or not all the syllables have been acquired. Here, since there is a next syllable at the position of the cursor, the CPU 10 determines that not all the syllables have been acquired, and the process once again returns to step S10.

The operation of this performance processing is shown in FIG. 4. For example, as the second depression, when a key on the keyboard 40 has started to be pressed and reaches the upper position a at time t4, the first sensor 41*a* is turned on, and a sound generation instruction of the second key-on n2 is accepted at time t4 (step S12). As mentioned above, before time t4, the second syllable c2 is acquired and the sound generation timing corresponding to the consonant sound type is set (step S20 to step S22). Consequently, sound generation of the consonant sound of the acquired syllable is started in the sound source 13 at the set sound generation timing from the time t4. In this case, the set sound generation timing is "approximately 0.02 sec". As a result, as shown in part (b) of FIG. 4, at time t5, at which approximately 0.02 sec has elapsed from time t4, the consonant component 44*a* of "#-r" in the speech element data 44 shown in part (d) of FIG. 4 is generated at the pitch of E5 and the volume of the envelope indicated by a predetermined consonant envelope ENV42*b*. Consequently, the consonant component 44*a* of "#-r" is generated at the pitch of E5 and the predetermined volume indicated by the consonant envelope ENV42*b*. Next, when the key corresponding to the key-on n2 is pressed down to the intermediate position b and the second sensor 41*b* is turned on at time t6, sound generation of the vowel sound of the acquired syllable is started in the sound source 13 (step S30 to step S34). At the time of sound generation of this vowel sound, an envelope ENV2 having a volume of the velocity corresponding to the time difference between time t4 and time t6 is started, and the vowel component 44*b* of "'r-u"→"u'" in the speech element data 44 shown in part (d) of FIG. 4 is generated at the pitch of E5 and the volume of the envelope ENV2. As a result, sound generation of a singing sound of "ru" is generated. The envelope ENV2 is an envelope of a sustain sound in which the sustain persists until key-off of the key-on n2. The stationary part data of "u" in the vowel component 44*b* shown in part (d) of FIG. 4 is repeatedly reproduced until time t7 (key-off) at which the finger moves away from the key corresponding to the key-on n2 and the first sensor 41*a* turns from on to off. When the CPU 10 detects that the key corresponding to the key-on n2 is turned off at time t7, a key-off process is performed to mute the sound. Consequently, the singing sound of "ru" is muted in the release curve of the envelope ENV2, and as a result, sound generation is stopped.

By returning to step S10 in the performance processing, the CPU 10 reads "yo" which is the third syllable c3 on which the cursor of the designated lyrics is placed, from the data memory 18 in the syllable information acquisition processing of step S10. The CPU 10 determines that the syllable "yo" starts with the consonant "y" and determines that the consonant "y" is to be output. Also, the CPU 10 refers to the syllable information table 31 shown in FIG. 3A and sets a consonant sound generation timing according to the determined consonant sound type. In this case, the CPU 10 sets a consonant sound generation timing corresponding to the consonant sound type of "y". Further, the CPU 10 advances the cursor to the next syllable of the text data 30. As a result, the cursor is placed on "ko" of the fourth syllable c41. Next, in the speech element data selection processing of step S11, the sound source 13 selects from the phonemic chain data 32*a*, the speech element data "#-y" corresponding to "silence→consonant y" and the speech element data "y-o" corresponding to "consonant y→vowel o", and also selects from the stationary part data 32*b*, the speech element data "o" corresponding to "vowel o".

When the performance operator 16 is operated as the real-time performance progresses, a sound generation instruction of a third key-on n3 based on the key whose first sensor 41*a* is turned on is accepted in step S12. This sound generation instruction acceptance processing of step S12 accepts a sound generation instruction based on the key-on n3 of the operated performance operator 16, and the CPU 10 sets the sound source 13 with the timing of the key-on n3, and pitch information indicating the pitch of D5. In the sound generation processing of step S13, the sound source 13 starts counting a sound generation timing corresponding to the set consonant sound type. In this case, the consonant sound type is "y". Consequently, a sound generation timing corresponding to the consonant sound type "y" is set. Also, sound generation of the consonant component of "#-y" is started at the sound generation timing corresponding to the consonant sound type "y". At the time of this sound generation, sound generation is performed at the set pitch of D5 and the predetermined volume. When it is detected that the second sensor 41*b* is turned on in the key that detected that the first sensor 41*a* is turned on, sound generation of the speech element data of the vowel component of "y-o"→"o" is started in the sound source 13, and "yo" of the syllable c3 is generated. At the time of sound generation, the vowel component of "'y-o"→"o'" is generated at the pitch of D5 received at the time of acceptance of the sound generation instruction of the key-on n3, and at a volume according to the velocity corresponding to the time difference from the first sensor 41*a* being turned on to the second sensor 41*b* being turned on. As a result, sound generation of a singing sound of "yo" of the acquired syllable c3 is started. Further, in step S14, the CPU 10 determines whether or not all the syllables have been acquired. Here, since there is a next syllable at the position of the cursor, the CPU 10 determines that not all the syllables have been acquired, and the process once again returns to step S10.

By returning to step S10 in the performance processing, the CPU 10 reads "ko" which is the fourth syllable c41 on which the cursor of the designated lyrics is placed, from the data memory 18 in the syllable information acquisition processing of step S10. The CPU 10 determines that the syllable "ko" starts with the consonant "k" and determines that the consonant "k" is to be output. Also, the CPU 10 refers to the syllable information table 31 shown in FIG. 3A and sets a consonant sound generation timing according to the determined consonant sound type. In this case, the CPU 10 sets a consonant sound generation timing corresponding to the consonant sound type of "k". Further, the CPU 10 advances the cursor to the next syllable of the text data 30. As a result, the cursor is placed on "i" of the fifth syllable c42. Next, in the speech element data selection processing of step S11, the sound source 13 selects from the phonemic chain data 32*a*, the speech element data "#-k" corresponding to "silence→consonant k" and the speech element data "k-o" corresponding to "consonant k→vowel o", and also selects from the stationary part data 32*b*, the speech element data "o" corresponding to "vowel o".

When the performance operator 16 is operated as the real-time performance progresses, a sound generation instruction of a fourth key-on n4 based on the key whose first sensor 41*a* is turned on is accepted in step S12. This sound generation instruction acceptance processing of step S12 accepts a sound generation instruction based on the key-on n4 of the operated performance operator 16, and the CPU 10 sets the sound source 13 with the timing of the key-on n4, and the pitch information of E5. In the sound generation processing of step S13, counting of a sound generation timing corresponding to the set consonant sound type is started. In this case, since the consonant sound type is "k", a sound generation timing corresponding to "k" is set, and sound generation of the consonant component of "#-k" is started at the sound generation timing corresponding to the consonant sound type "k". At the time of this sound generation, sound generation is performed at the set pitch of E5 and the predetermined volume. When it is detected that the second sensor 41*b* is turned on in the key that detected that the first sensor 41*a* is turned on, sound generation of the speech element data of the vowel component of '"k-o"→"o"' is started in the sound source 13, and "ko" of the syllable c41 is generated. At the time of sound generation, the vowel component of '"y-o"→"o"' is generated at the pitch of E5 received at the time of acceptance of the sound generation instruction of the key-on n4, and at a volume according to the velocity corresponding to the time difference from the first sensor 41*a* being turned on to the second sensor 41*b* being turned on. As a result, sound generation of a singing sound of "ko" of the acquired syllable c41 is started. Further, in step S14, the CPU 10 determines whether or not all the syllables have been acquired, and here, since there is a next syllable at the position of the cursor, it determines that not all the syllables have been acquired, and the process once again returns to step S10.

As a result of the performance processing returning to step S10, the CPU 10 reads "i" which is the fifth syllable c42 on which the cursor of the designated lyrics is placed, from the data memory 18 in the syllable information acquisition processing of step S10. Also, it refers to the syllable information table 31 shown in FIG. 3A and sets a consonant sound generation timing according to the determined consonant sound type. In this case, a consonant sound is not generated since there is no consonant sound type. That is, the CPU 10 determines that the syllable "i" starts with the vowel "i", and determines that a consonant sound is not output. Further, it advances the cursor to the next syllable of the text data 30. However, this step is skipped because there is no next syllable.

The case where a syllable includes a flag such that "ko" and "i" which are syllables c41 and c42, are generated with a single key-on will be described. In this case, "ko" which is syllable c41, is generated by the key-on n4, and "i" which is syllable c42, is generated when the key-on n4 is turned off. That is, in the case where the flag described above is included in the syllables c41 and c42, the same process as the speech element data selection processing of step S11 is performed when it is detected that the key-on n4 is turned off, and the sound source 13 selects from the phonemic chain data 32*a*, the speech element data "o-i" corresponding to "vowel o→vowel i", and also selects from the stationary part data 32*b*, the speech element data "i" corresponding to "vowel i". Next, the sound source 13 starts sound generation of the speech element data of the vowel component of "o-i"→"i", and generates "i" of the syllable c41. Consequently, a singing sound of "i" of c42 is generated with the same pitch E5 as "ko" of c41 at the volume of the release curve of the envelope ENV of the singing sound of "ko". In response to the key-off, a muting process of the singing sound of "ko" is performed, and sound generation is stopped. As a result, the sound generation becomes '"ko"→"i"'.

As described above, the singing sound generating apparatus 1 according to the embodiment of the present invention starts sound generation of a consonant sound when a consonant sound generation timing is reached, referenced to the timing at which the first sensor 41*a* is turned on, and then starts sound generation of a vowel sound at the timing at which the second sensor 41*b* is turned on. Consequently, the singing sound generating apparatus 1 according to the embodiment of the present invention operates according to a key depression speed corresponding to the time difference from when the first sensor 41*a* is turned on to when the second sensor 41*b* is turned on. Therefore, the operation of three cases having different key depression speeds will be described below with reference to FIG. 6A to 6C.

Figure 6A:
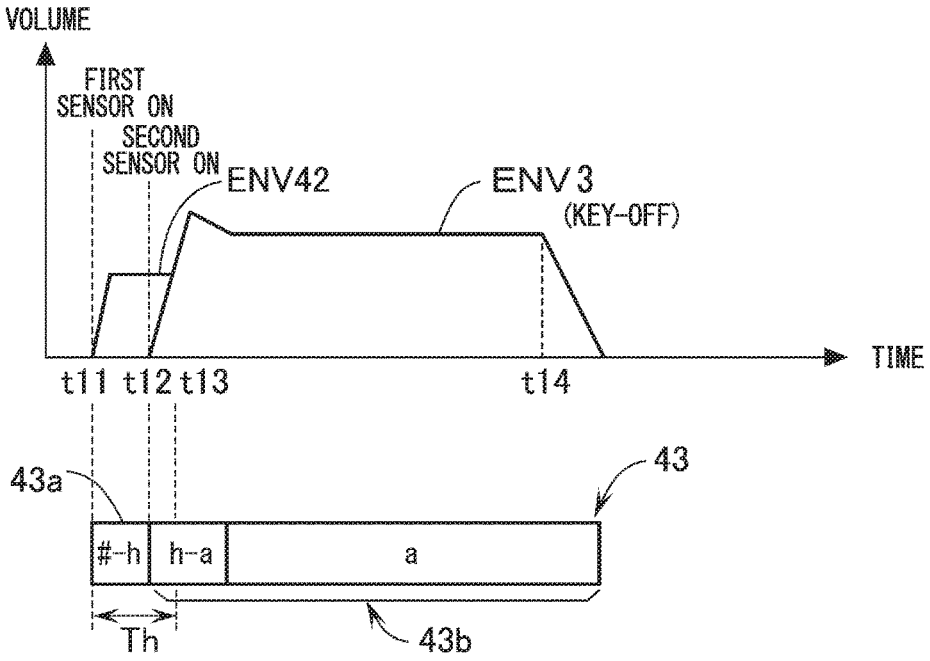
FIG. 6A is a timing chart showing another operation of the singing sound generating apparatus according to the embodiment of the present invention.

FIG. 6A shows the case where the timing at which the second sensor 41*b* is turned on is appropriate. For each consonant sound, a sound generation length that sounds natural is predefined. The sound generation length that sounds natural for consonant sounds such as "s" and "h" is long. The sound generation length that sounds natural for consonants such as "k", "t", and "p" is short. Here, it is assumed that for the speech element data 43, the consonant component 43*a* of "#-h" and the vowel components 43*b* of "h-a" and "a" are selected, and the maximum consonant sound length of "h", in which the "ha" line in the Japanese syllabary diagram sounds natural, is represented by Th. In the case where the consonant sound type is "h", as shown in the syllable information table 31, the consonant sound generation timing is set to "immediate". In FIG. 6A, the first sensor 41*a* is turned on at time t11, and "immediate" sound generation of the consonant component of "#-h" is started at the volume of the envelope represented by the consonant envelope ENV42. Then, in the example shown in FIG. 6A, the second sensor 41*b* is turned on at time t12 immediately prior to the time Th elapsing from time tn. In this case, at the time t12 at which the second sensor 41*b* is turned on, sound generation of the consonant component 43*a* of "#-h" transitions to sound generation of the vowel sound, and sound generation of the vowel component 43*b* of '"h-a"→"a"' is started at the volume of the envelope ENV3. Consequently, both the object of starting sound generation of the consonant sound before key depression and the object of starting sound generation of the vowel sound at a timing corresponding to key depression can be achieved. The vowel sound is muted by the key-off at time t14, and as a result, sound generation is stopped.

Figure 6B:
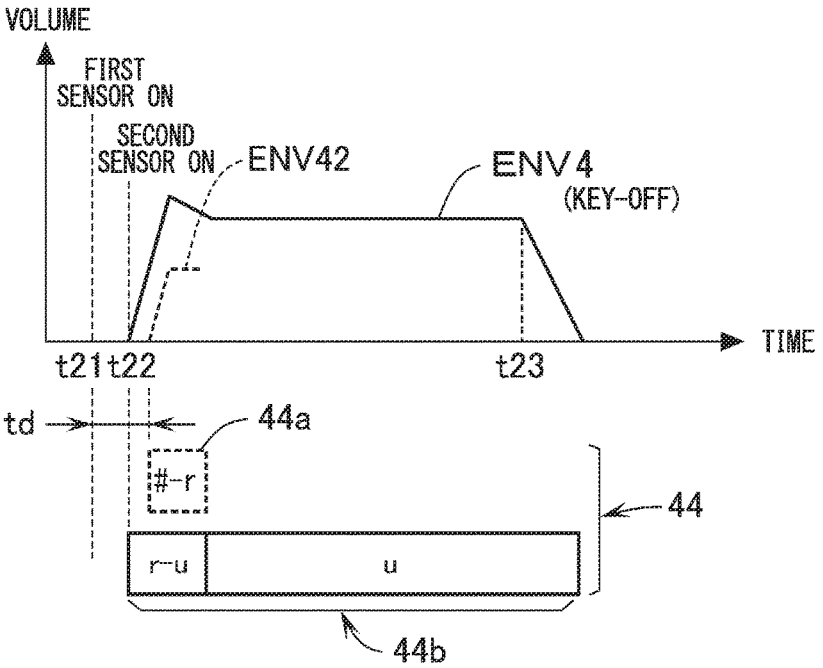
FIG. 6B is a timing chart showing another operation of the singing sound generating apparatus according to the embodiment of the present invention.

FIG. 6B shows the case where the time at which the second sensor 41*b* is turned on is too early. For a consonant sound type in which a waiting time occurs from when the first sensor 41*a* is turned on at time t21 to when sound generation of the consonant sound is started, there is a possibility that the second sensor 41 is turned on during the waiting time. For example, when the second sensor 41*b* is turned on at time t22, sound generation of the vowel sound is started accordingly. In this case, if the consonant sound generation timing of the consonant sound has not yet been reached at time t22, the consonant sound will be generated after sound generation of the vowel sound. However, it sounds unnatural for sound generation of the consonant sound to be later than the sound generation of the vowel sound. Consequently, in the case where it is detected that the second sensor 41*b* is turned on before sound generation of the consonant sound is started, the CPU 10 cancels sound generation of the consonant sound. As a result, the consonant sound is not generated. Here, the case will be described where for the speech element data 44 of the consonant component 44*a* of "#-r" and the vowel components 44*b* of "r-u" and "u" is selected, and further, as shown in FIG. 6B, the consonant sound generation timing of the consonant component 44*a* of "#-r" is a time in which a time td has elapsed from time t21. In this case, when the second sensor 41*b* is turned on at time t22 before reaching the consonant sound generation timing, sound generation of the vowel sound is started at time t22. In this case, although sound generation of the consonant component 44*a* of "#-r" indicated by the broken line frame in FIG. 6B is canceled, sound generation of the phonemic chain data of "r-u" in the vowel component 44*b* is performed. Consequently, although for a very short time, the consonant sound is also generated at the start of the vowel sound, and it does not completely become only the vowel sound. In addition, in many cases, consonant sound types in which a waiting time occurs after the first sensor 41*a* is turned on, originally have a short consonant sound generation length. Consequently, there is not a large auditory discomfort even if sound generation of the consonant sound is canceled as described above. In the example shown in FIG. 6B, the vowel component 44*b* of "'r-u"→"u"' is generated at the volume of the envelope ENV4. It is muted by the key-off at time t23, and as a result, sound generation is stopped.

Figure 6C:
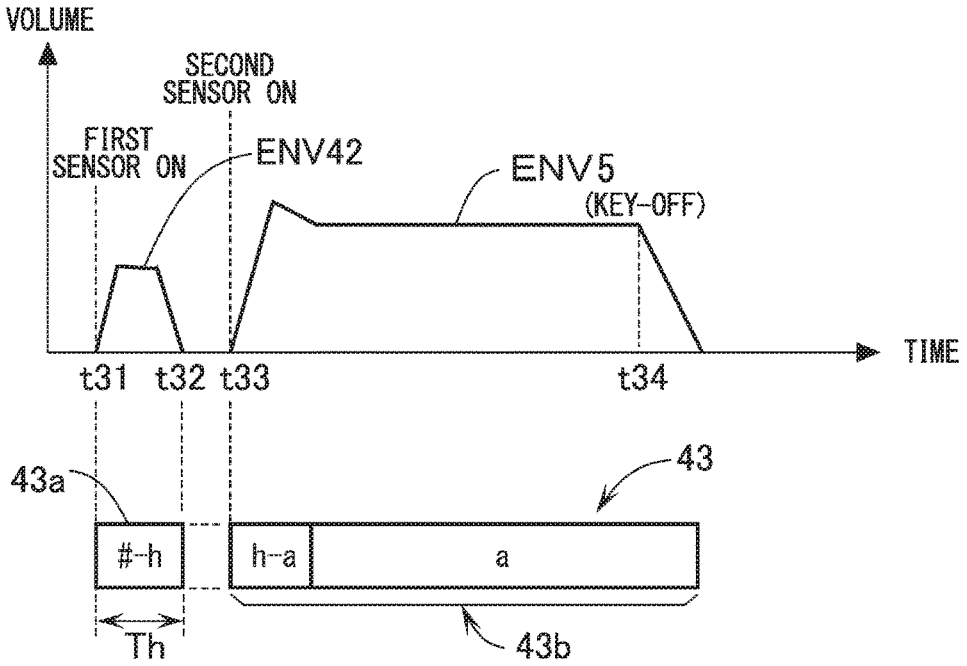
FIG. 6C is a timing chart showing another operation of the singing sound generating apparatus according to the embodiment of the present invention.

FIG. 6C shows the case where the second sensor 41*b* is turned on too late. When the first sensor 41*a* is turned on at time t31 and the second sensor 41*b* is not turned on even after the maximum consonant sound length Th has elapsed from the time t31, sound generation of the vowel sound is not started until the second sensor 41*b* is turned on. For example, in the case a finger accidentally has touched a key, even if the first sensor 41*a* responds and is turned on, sound generation is stopped at the consonant sound as long as the key is not pressed down to the second sensor 41*b*. Therefore, sound generation by an erroneous operation is not noticeable. As another example, the case will be described where for the speech element data 43, the consonant component 43*a* of "#-h" and the vowel components 44*b* of "h-a" and "a" are selected, and the operation is simply very slow rather than an erroneous operation. In this case, when the second sensor 41*b* is turned on at time t33 after the maximum consonant sound length Th has elapsed from time t31, in addition to the stationary part data of "a" in the vowel component 43*b*, sound generation of the phonemic chain data of "h-a" in the vowel component 43*b*, which is a transition from the consonant sound to the vowel sound, is also performed. Therefore, there is not a large auditory discomfort. In the example shown in FIG. 6C, the consonant component 43*a* of "#-h" is generated at the volume of the envelope represented by the consonant envelope ENV42. The vowel component 43*b* of "'h-a"→"a"' is generated at the volume of the envelope ENV5. It is muted by the key-off at time t34, and as a result, sound generation is stopped.

The sound generation length in which the "sa" line of the Japanese syllabary diagram sounds natural is 50 to 100 ms. In a normal performance, the key depression speed (the time taken from when the first sensor 41*a* is turned on to when the second sensor 41*b* is turned on) is approximately 20 to 100 ms. Consequently, in reality the case shown in FIG. 6C rarely occurs.

The case where the keyboard which is a performance operator, is a three-make keyboard provided with a first sensor to a third sensor has been described. However, it is not limited to such an example. The keyboard may be a two-make keyboard provided with a first sensor and a second sensor without a third sensor.

Figure 7:
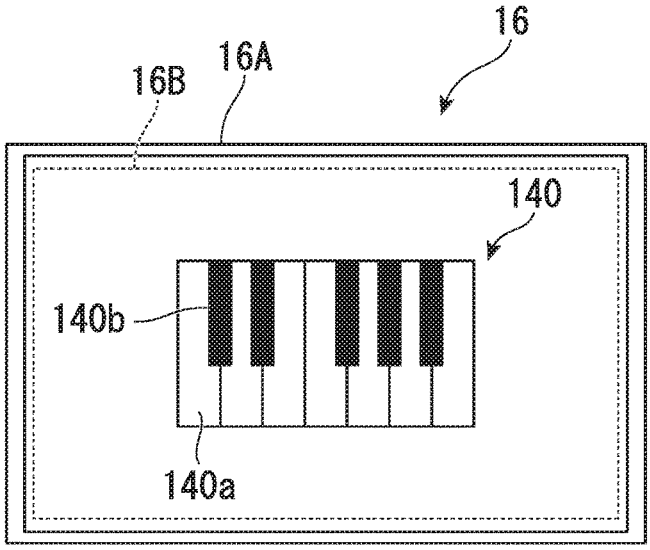
FIG. 7 is a diagram showing a schematic configuration showing a modified example of the performance operator of the singing sound generating apparatus according to the embodiment of the present invention.

The keyboard may be a keyboard provided with a touch sensor on the surface that detects contact, and may be provided with a single switch that detects downward pressing to the interior. In this case, for example, as shown in FIG. 7, the performance operator 16 may be a liquid-crystal display 16A and a touch sensor (touch panel) 16B laminated on the liquid-crystal display 16A. In the example shown in FIG. 7, the liquid-crystal display 16A displays a keyboard 140 including white keys 140*b* and black keys 141*a*. The touch sensor 16B detects contact (an example of the first operation) and a push-in (an example of the second operation) at the positions where the white keys 140*b* and the black keys 141*a* are displayed.

In the example shown in FIG. 7, the touch sensor 16B may detect a tracing operation of the keyboard 140 displayed on the liquid-crystal display 16A. In this configuration, a consonant sound is generated when an operation (contact) (an example of the first operation) on the touch sensor 16B begins, and a vowel sound is generated by performing, in continuation of the operation, a drag operation (an example of the second operation) of a predetermined length on the touch sensor 16B.

For detection of an operation on the performance operator, a camera may be used in place of a touch sensor to detect contact (near-contact) of a finger of an operator on a keyboard.

Processing may be carried out by recording a program for realizing the functions of the singing sound generating apparatus 1 according to the above-described embodiments, in a computer-readable recording medium, and reading the program recorded on this recording medium into a computer system, and executing the program.

The "computer system" referred to here may include hardware such as an operating system (OS) and peripheral devices.

The "computer-readable recording medium" may be a writable nonvolatile memory such as a flexible disk, a magneto-optical disk, a ROM (Read Only Memory), or a flash memory, a portable medium such as a DVD (Digital Versatile Disk), or a storage device such as a hard disk built into the computer system.

"Computer-readable recording medium" also includes a medium that holds programs for a certain period of time such as a volatile memory (for example, a DRAM (Dynamic Random Access Memory)) in a computer system serving as a server or a client when a program is transmitted via a network such as the Internet or a communication line such as a telephone line.

The above program may be transmitted from a computer system in which the program is stored in a storage device or the like, to another computer system via a transmission medium or by a transmission wave in a transmission medium. A "transmission medium" for transmitting a program means a medium having a function of transmitting information such as a network (communication network) such as the Internet and a telecommunication line (communication line) such as a telephone line.

The above program may be for realizing a part of the above-described functions. The above program may be a so-called difference file (difference program) that can realize the above-described functions by a combination with a program already recorded in the computer system.

What is claimed is:

1. A sound control device comprising:

a storage unit that stores syllable information about a syllable that:

in a case where the syllable is composed of only a vowel sound, starts with the vowel sound; and in a case where the syllable is composed of a consonant sound and the vowel sound, starts with the consonant sound and continues with the vowel sound after the consonant sound;

a detection unit that detects a first operation on an operator and a second operation on the operator, the second operation being performed after the first operation; and a control unit that:

causes output of the consonant sound of the syllable to be started in response to the first operation being detected;

causes output of the vowel sound of the syllable to be started, after causing the output of the consonant sound of the syllable to be started, in response to the second operation being detected;

reads the syllable information from the storage unit and determines whether the syllable starts with the consonant sound or the vowel sound;

determines that the consonant sound is to be output in a case where the control unit determines that the syllable starts with the consonant sound; and determines that the consonant sound is to be not output in a case where the control unit determines that the syllable starts with the vowel sound.

2. The sound control device according to claim 1, wherein:

the operator accepts push-in by a user, the detection unit detects:

as the first operation, that the operator has been pushed in by a first distance from a reference position; and as the second operation, that the operator has been pushed in by a second distance from the reference position, the second distance being longer than the first distance.

3. The sound control device according to claim 1, wherein:

the detection unit comprises first and second sensors provided in the operator, the first sensor detects the first operation, and the second sensor detects the second operation.

4. The sound control device according to claim 1, wherein the operator comprises a keyboard that accepts the first and second operations.

5. The sound control device according to claim 1, wherein the operator comprises a touch panel that accepts the first and second operations.

6. The sound control device according to claim 1, wherein:

the operator is associated with a pitch, and the control unit causes the consonant and vowel sounds of the syllable to be output at the pitch.

7. The sound control device according to claim 1, wherein:

the operator comprises a plurality of operators associated with a plurality of mutually different pitches, respectively, the detection unit detects the first and second operations on an arbitrary one operator among the plurality of operators, and the control unit causes the consonant and vowel sounds of the syllable to be output at a pitch associated with the one operator.

8. The sound control device according to claim 1, wherein the control unit controls a timing at which output of the consonant sound of the syllable is started according to a type of the consonant sound.

9. The sound control device according to claim 1, wherein the control unit, in a case where the syllable is composed of the consonant sound and the vowel sound:

causes the consonant sound of the syllable to be output; and causes the vowel sound of the syllable to be output.

10. The sound control device according to claim 1, wherein, in a case where the syllable is composed of the consonant sound and the vowel sound:

the vowel sound of the syllable follows the consonant sound of the syllable, and the vowel sound of the syllable comprises a speech element corresponding to a change from the consonant sound to the vowel sound.

11. The sound control device according to claim 10, wherein, in a case where the syllable is composed of the consonant sound and the vowel sound, the vowel sound of the syllable further comprises a speech element corresponding to continuation of the vowel sound.

12. The sound control device according to claim 1, wherein the syllable is a single character or a single Japanese kana.

13. A sound control method comprising:

storing, in a storage unit, syllable information about a syllable that:

in a case where the syllable is composed only of a vowel sound, starts with the vowel sound; and in a case where the syllable is composed of a consonant sound and the vowel sound, starts with the consonant sound and continues with the vowel sound after the consonant sound;

detecting a first operation on an operator and a second operation on the operator, the second operation being performed after the first operation;

causing output of the consonant sound of the syllable to be started in response to the first operation being detected;

causing output of the vowel sound of the syllable to be started, after causing the output of the consonant sound of the syllable to be started, in response to the second operation being detected;

reading the syllable information from the storage unit and determining whether the syllable starts with the consonant sound or the vowel sound;

determining that the consonant sound is to be output in a case where the syllable is determined to start with the consonant sound; and determining that the consonant sound is to be not output in a case where the syllable is determined to start with the vowel sound.

14. A non-transitory computer-readable recording medium storing a program executable by a computer to execute a method comprising:

storing, in a storage unit, syllable information about a syllable that:

in a case where the syllable is composed only of a vowel sound, starts with the vowel sound; and in a case where the syllable is composed of a consonant sound and the vowel sound, starts with the consonant sound and continues with the vowel sound after the consonant sound;

detecting a first operation on an operator and a second operation on the operator, the second operation being performed after the first operation;

causing output of the consonant sound of the syllable to be started in response to the first operation being detected;

causing output of the vowel sound of the syllable to be started, after causing the output of the consonant sound of the syllable to be started, in response to the second operation being detected;

reading the syllable information from the storage unit and determining whether the syllable starts with the consonant sound or the vowel sound;

determining that the consonant sound is to be output in a case where the syllable is determined to start with the consonant sound; and determining that the consonant sound is to be not output in a case where the syllable is determined to start with the vowel sound.

15. A sound control device comprising:

a storage unit that stores a syllable information table in which a type of a consonant sound and a timing at which output of the consonant sound is started are associated, wherein the consonant sound and a vowel sound constitute a single syllable;

a detection unit that detects a first operation on an operator and a second operation on the operator, the second operation being performed after the first operation;

a control unit that:

causes output of the consonant sound of the single syllable to be started in response to the first operation being detected;

causes output of the vowel sound of the single syllable to be started, after causing the output of the consonant sound of the single syllable to be started, in response to the second operation being detected;

reads the syllable information table from the storage unit;

acquires the timing associated with the type of the consonant sound of the single syllable by referring to the read syllable information table; and causes output of the consonant sound of the single syllable to be started at the acquired timing.

16. The sound control device according to claim 15, wherein:

the storage unit further stores syllable information about the single syllable, the single syllable starts with the consonant sound and continues with the vowel sound after the consonant sound, the control unit:

reads the syllable information from the storage unit;

causes the consonant sound of the syllable to be output; and causes the vowel sound of the syllable to be output.

17. The sound control device according to claim 15, wherein:

the vowel sound follows the consonant sound in the single syllable, and the vowel sound of the single syllable comprises a speech element corresponding to a change from the consonant sound to the vowel sound.

18. The sound control device according to claim 17, wherein the vowel sound of the single syllable further comprises a speech element corresponding to continuation of the vowel sound.

19. The sound control device according to claim 15, wherein the single syllable is a single character or a single Japanese kana.

20. A sound control method comprising:

storing, in a storage unit, a syllable information table in which a type of a consonant sound and a timing at which output of the consonant sound is started are associated, wherein the consonant sound and a vowel sound constitute a single syllable;

detecting a first operation on an operator and a second operation on the operator, the second operation being performed after the first operation;

causing output of the consonant sound of the single syllable to be started in response to the first operation being detected;

causing output of the vowel sound of the single syllable to be started, after causing the output of the consonant sound of the single syllable to be started, in response to the second operation being detected;

reading the syllable information table stored in the storage unit; and acquiring the timing associated with the type of the consonant sound of the single syllable by referring to the read syllable information table, wherein the causing of the output of the consonant sound comprises causing output of the consonant sound of the single syllable to be started at the acquired timing.

21. A non-transitory computer-readable recording medium storing a program executable by a computer to execute a method comprising:

storing, in a storage unit, a syllable information table in which a type of a consonant sound and a timing at which output of the consonant sound is started are associated, wherein the consonant sound and a vowel sound constitute a single syllable;

detecting a first operation on an operator and a second operation on the operator, the second operation being performed after the first operation;

causing output of the consonant sound of the single syllable to be started in response to the first operation being detected;

causing output of the vowel sound of the single syllable to be started, after causing the output of the consonant sound of the single syllable to be started, in response to the second operation being detected;

reading the syllable information table stored in the storage unit; and acquiring the timing associated with the type of the consonant sound of the single syllable by referring to the read syllable information table, wherein the causing of the output of the consonant sound comprises causing output of the consonant sound of the single syllable to be started at the acquired timing.

* * * * *